United States Patent [19]

Tanaka et al.

[11] Patent Number: 4,622,290

[45] Date of Patent: Nov. 11, 1986

[54] SILVER HALIDE PHOTOGRAPHIC EMULSION

[75] Inventors: Akira Tanaka; Hidetoshi Miura, both of Nagaokakyo, Japan

[73] Assignee: Mitsubishi Paper Mills, Ltd., Tokyo, Japan

[21] Appl. No.: 795,254

[22] Filed: Nov. 5, 1985

[30] Foreign Application Priority Data

Nov. 9, 1984 [JP] Japan ..... 59-236040

[51] Int. Cl.[4] ..... G03C 1/19

[52] U.S. Cl. ..... 430/574; 430/588

[58] Field of Search ..... 430/574, 588

[56] References Cited

U.S. PATENT DOCUMENTS

| | | | |
|---|---|---|---|
| 3,463,640 | 8/1969 | Ficken et al. | 430/574 |
| 3,617,293 | 11/1971 | Shiba et al. | 430/574 |
| 3,660,099 | 5/1972 | Sato et al. | 430/574 |
| 3,677,765 | 7/1972 | Nadazawa et al. | 430/574 |
| 4,308,345 | 12/1981 | Hinata et al. | 430/574 |

*Primary Examiner*—Richard L. Schilling

*Attorney, Agent, or Firm*—Cushman, Darby & Cushman

[57] ABSTRACT

Disclosed is a silver halide photographic emulsion made highly sensitive to white light by use of a combination of at least one sensitizing dye represented by the general formula:

[I]

wherein $R_1$ represents a hydrogen atom, an alkyl group, or an aralkyl group, $R_2$ represents a sulfoalkyl group, or a sulfoaralkyl group, and $R_3$ represents an unsubstituted or substituted alkyl group, and at least one sensitizing dye represented by the general formula:

[II]

wherein $W_1$ to $W_4$ represent each an alkyl group, an alkoxy group, or a hydroxyl group, or a pair of $W_1$ and $W_2$ or a pair of $W_3$ and $W_4$ forms an alkylenedioxy group, provided that said pair of $W_1$ and $W_2$ and said pair of $W_3$ and $W_4$ have each at least one alkoxy or hydroxyl group or said alkylenedioxy group; $R_4$ represents a hydrogen atom, an alkyl group, an aralkyl group, or an aryl group; $R_5$ represents a sulfoalkyl group or a sulfoaralkyl group; and $R_6$ represents an unsubstituted or substituted alkyl group.

6 Claims, No Drawings

SILVER HALIDE PHOTOGRAPHIC EMULSION

BACKGROUND OF THE INVENTION

This invention relates to a spectral-sensitized silver halide photographic emulsion and, more particularly, to a silver halide photographic emulsion made highly sensitive to white light, especially to red spectral region by the use of a combination of at least two sensitizing dyes.

The silver halide photosensitive materials are required to be highly sensitive to specific wavelength regions which vary with the purpose of use of particular photosensitive material. It is well known that as one of the techniques in producing such a photosensitive material, a certain type of sensitizing dye is added to the silver halide emulsion to increase effectively the sensitivity to the specific region of wavelengths longer than those characteristic of a silver halide. It is further known that when the said sensitizing dye is used in combination with a certain other type of sensitizing dye or a certain organic compound, the emulsion is imparted with a sensitivity greater than the sum of sensitivities imparted by the individual dye or compound. Such an enhanced effect is called supersensitization and a number of such combinations have been reported. There have recently been required more sensitive silver halide photosensitive emulsions and, hence, it is important to develop a technique capable of achieving more efficient spectral sensitization. In producing photosensitive materials of high sensitivity, it is most advantageous to use a combination of at least two sensitizing dyes which are in supersensitization relation and which accompany no desensitization. With the recent rapid progress in optoelectronics, laser and LED have come into practical use in place of conventional incandescent lamp and the like as the light source for converting a signal current into a light signal which is used in image processing. Especially, the emission wavelengths of He-Ne laser, ruby laser, and red light emission diode, which are already put into practical use, are in the spectral region of from 600 to 700 nm, but the actual situation is such that few of the conventional supersensitizing combination can impart sufficient red sensitivity to photosensitive materials which are to be used in recording red light within said wavelength region.

SUMMARY OF THE INVENTION

The primary object of this invention is to provide a silver halide photographic emulsion which has a high speed to white light, especially to red spectral region.

DESCRIPTION OF THE INVENTION

The primary object of this invention has been achieved by incorporating a combination of at least one of the sensitizing dyes represented by the following general formula [I] and at least one of the sensitizing dyes represented by the following general [II] into a silver halide photographic emulsion:

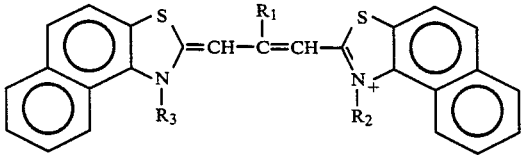

[I]

wherein $R_1$ represents a hydrogen atom, an alkyl group (e.g. a lower alkyl group such as methyl, ethyl, propyl, or pentyl group) or an aralkyl group (e.g. benzyl or phenethyl group); $R_2$ represents a sulfoalkyl group (e.g. β-sulfoethyl, γ-sulfopropyl, γ-sulfobutyl, or δ-sulfobutyl group) or a sulfoaralkyl group (e.g. sulfobenzyl or sulfophenethyl group), and $R_3$ represents an unsubstituted or substituted alkyl group (e.g. unsubstituted lower alkyl groups described above with respect to $R_1$; substituted alkyl groups such as β-hydroxyethyl, γ-hydroxypropyl, β-acetoxyethyl, β-benzoyloxyethyl, γ-acetoxypropyl, β-methoxyethyl, γ-methoxypropyl, carboxymethyl, β-carboxyethyl, γ-carboxypropyl, methoxycarbonylmethyl, ethoxycarbonylmethyl, β-methoxycarbonylethyl, γ-methoxycarbonylpropyl, β-sulfoethyl, γ-sulfopropyl, γ-sulfobutyl, δ-sulfobutyl, allyl, benzyl, phenethyl, and p-sulfobenzyl groups); when the dye is a sulfo-anionic type, one of the sulfo groups may be in the form of alkali metal salt (e.g. potassium salt or sodium salt) or ammonium salt (e.g. ammonium salt, triethylamine salt, or pyridinium salt).

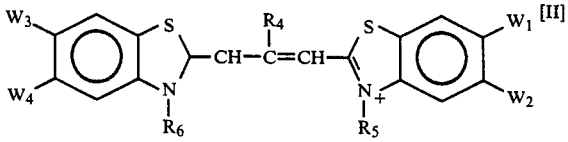

[II]

wherein $W_1$ to $W_4$ represent each an alkyl group (e.g. lower alkyl groups described above with respect to $R_1$ of general formula [I]), an alkoxy group (e.g. methoxy, ethoxy, propoxy, butoxy, pentyloxy, benzyloxy, and phenethyloxy groups), or a hydroxyl group, or a pair of $W_1$ and $W_2$ or a pair of $W_3$ and $W_4$ forms an alkylenedioxy group (e.g. methylenedioxy or ethylenedioxy group), provided that said pair of $W_1$ and $W_2$ and said pair of $W_3$ and $W_4$ have each at least one alkoxy, hydroxyl, or said alkylenedioxy, group; $R_4$ represents a hydrogen atom, an alkyl group (e.g. a lower alkyl group described above with respect to $R_1$ of general formula [I]), an aralkyl group (e.g. a group described above with respect to $R_1$ of general formula [I]), or an aryl group (e.g. phenyl or p-methoxyphenyl group); $R_5$ represents a sulfoalkyl group or a sulfoaralkyl group (e.g. those described above with respect to $R_2$ of general formula [I]); and $R_6$ represents an unsubstituted or substituted alkyl group (e.g. those described above with respect to $R_3$ of general formula [I]); when the dye is an anionic type, one of the sulfo groups may be in the form of alkali metal salt or ammonium salt, similarly to the dyes represented by general formula [I].

4,5-Benzothiacarbocyanine represented by the general formula [I] is a well known sensitizing dye which shows a sharp J-band corresponding to J-aggregate and has a high red sensitivity, while thiacarbocyanine represented by the general formula [II] is a sensitizing dye which is weakly adsorbed on a silver halide surface and when it is an anionic type, the hydrophilicity becomes markedly increased, whereby the diffusion in silver halide surface occurs. The present inventors found that the sensitizing speed of a sensitizing dye [I], is enhanced when it is used in a combination of a sensitizing dye [II]. The J-aggregates of the sensitizing dye [I] becomes properly broken up in the presence of a sensitizing dye [II] to cause spectral blue shift and the maximum sensitivity appears at a wavelength between the wavelengths of sensitivity maxima of each sensitizing dye used alone, resulting in an increase in not only red sensitivity but also white light sensitivity. By changing the ratio of dyes (I) and (II), it is possible to change almost freely the intensity distribution of wavelength of maximum sensitivity. Moreover, it is possible to achieve maximum sensitivity with small amounts of dyes, leading to the reduction in residual color (color stain) after development.

The supersensitized red-sensitive silver halide photographic emulsion according to this invention renders the photographic material highly sensitive to red and, as a consequence, makes it useful as a high sensitivity black and white photosensitive material, red sensitive color photosensitive material, and other sensitive materials such as, for example, those of DTR type and colored dye type based on the silver dye bleach process.

Examples of individual sensitizing dyes represented by the general formulas [I] and [II] are listed below, but the sensitive dyes used in the present invention are not limited thereto.

Examples of sensitizing dyes represented by the general formula [I]:

[I-A]

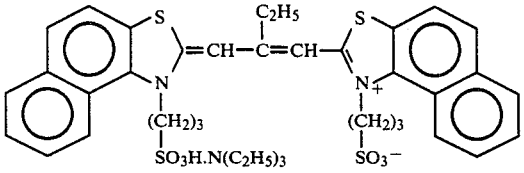

[I-B]

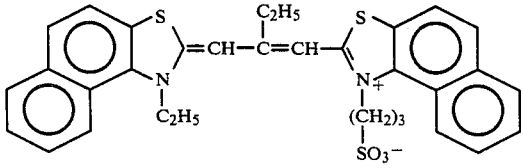

-continued

[I-C]

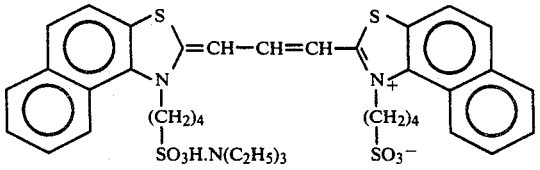

[I-D]

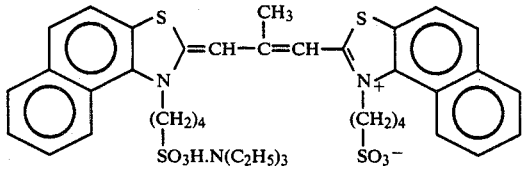

[I-E]

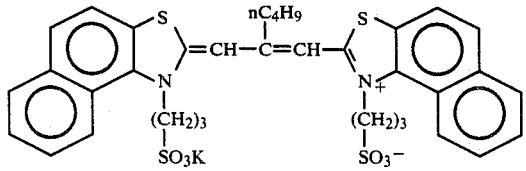

[I-F]

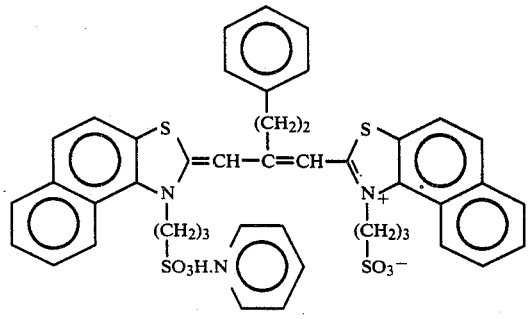

Examples of sensitizing dyes represented by the general formula [II]:

[II-A]

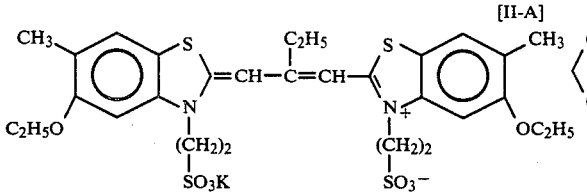

[II-B]

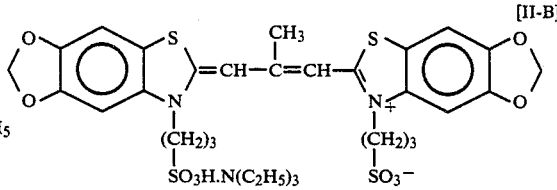

[II-C]

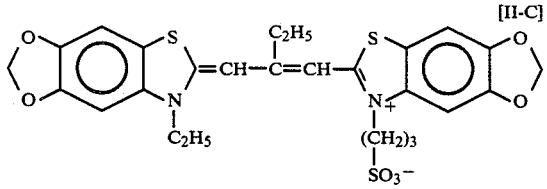

[II-D]

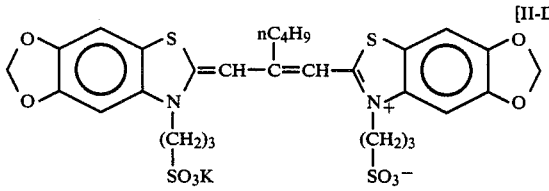

[II-E]

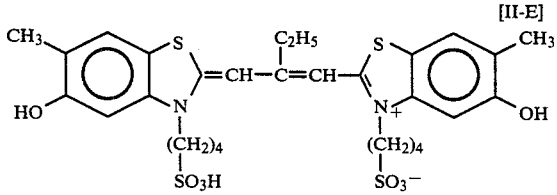

[II-F]

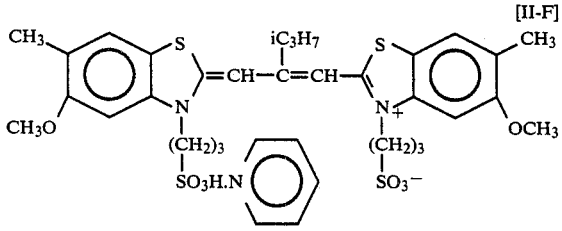

-continued
[II-G]
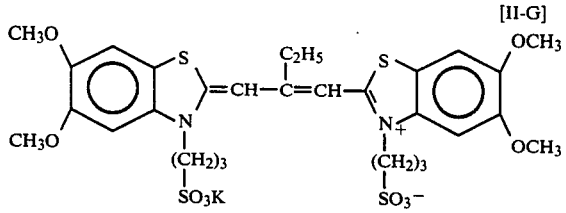
[II-H]
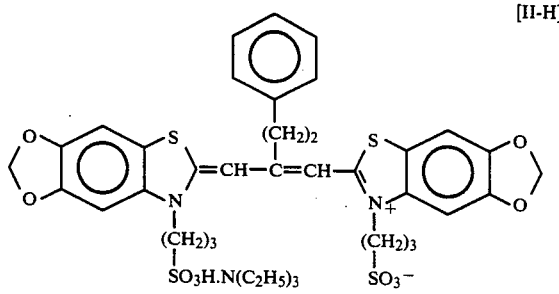
[II-I]
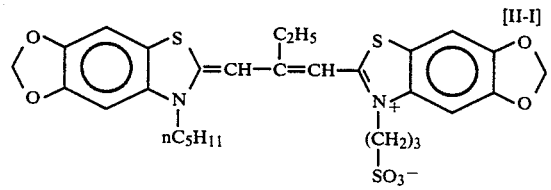
[II-J]
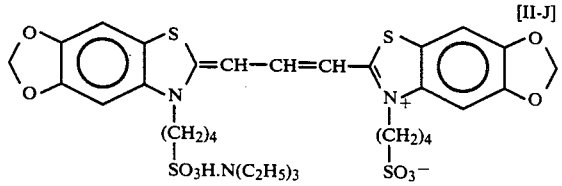
[II-K]
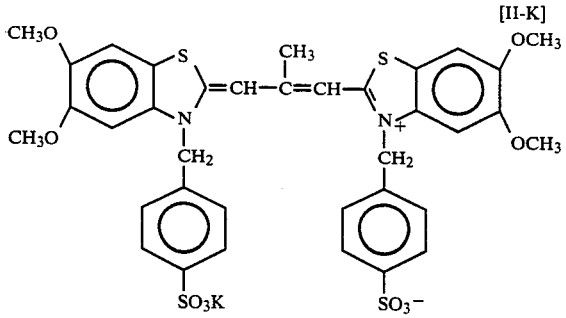
[II-L]
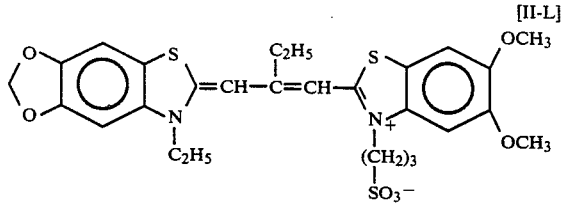
[II-M]
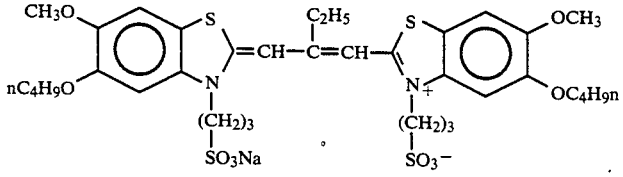
[II-N]
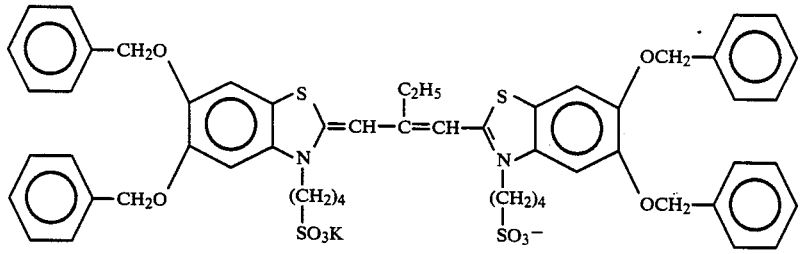
[II-O]
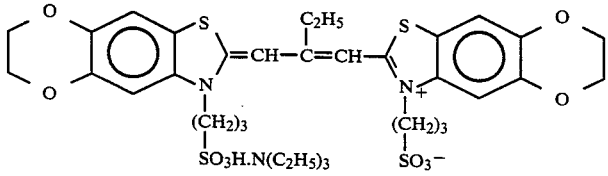

-continued

[II-Q]

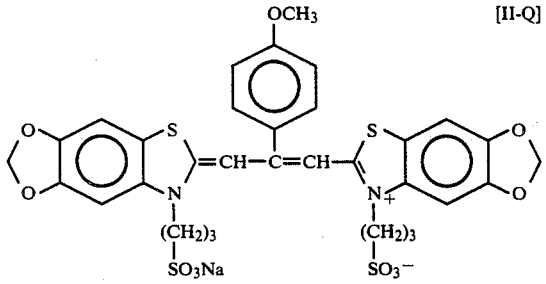

[II-R]

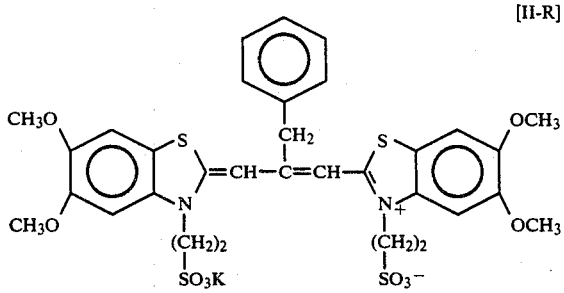

The sensitizing dyes used in the photographic emulsion of this invention are prepared in usual manner. Methods of synthesis of the dyes are well documented for example in U.S. Pat. No. 2,503,776 and 3,117,210, Brit Pat. No. 742,112, Ger. Pat. No. 929,080 and 1,072,765.

The silver halide photographic emulsion of this invention can be prepared from any of the silver chloride, silver bromide, silver chlorobromide, silver bromoiodide, and silver chlorobromoiodide emulsions produced in common ways. The sensitizing dyes can be added in the form of solution in a solvent such as methanol, isopropanol, pyridine, dimethylformamide, water, or mixtures thereof, or by dispersing the dyes directly in the emulsion by ultrasonic means. It is further possible to use the methods described in U.S. Pat. Nos. 3,482,981, 3,585,195, 3,469,987, 3,649,286, 3,485,634, 3,342,605, and 2,912,343.

The sensitizing dyes may be added to the silver halide photographic emulsion at any stage in the production of the emulsion, but preferably added immediately after completion of second ripening. Although the amount to be added of the dye depends on the type of dye and the type of silver halide photographic emulsion, the combined amount of dyes of general formulas [I] and [II] is in the broad range of from 0.01 to 10 g for 1 kg of silver halide in terms of silver nitrate. The mixing ratio of dye [I] to dye [II] is preferably in the range of from 10:1 to 1:10 but, if necessary, other ratios are not excluded. Both dyes are added in no particular order and can be added in mixed solution form.

The silver halide photographic emulsion of this invention can be chemically sensitized with noble metals, sulfur, or by reduction or a combination thereof. A polyalkylene oxide compound can also be added. If necessary, the emulsion can be spectral-sensitized with other sensitizing dyes such as, for example, cyanine and merocyanine dyes. The emulsion may contain other additives such as stabilizers, surface active agents, and hardeners. When used in a photosensitive material for color photography, the emulsion of this invention can contain a coupler and a surface active agent for the coupler. The protective colloid layers used in the photographic layers of this invention include gelatin, gelatin derivatives such as phthalated or malonated gelatin, cellulose derivatives, soluble starch, and water-soluble polymers. Plasticizers such as polymer latices can be added to improve dimensional stability. The emulsion can be coated on supports such as baryta paper, resin-coated paper, synthetic paper, and natural or synthetic film bases of the cellulose triacetate type or polyester type.

The invention is further illustrated in detail below with reference to Example, but the invention is not limited thereto and many modifications may be made within the scope of appended claims.

EXAMPLE

A silver chloride emulsion was prepared by following the usual procedure. After second ripening of sulfur sensitization, the emulsion was divided into a number of portions and the solutions of two types of sensitizing dyes each alone or in mixtures were added to the divided portions of emulsion as shown in Table 1. The emulsion was allow to stand for 45 minutes at about 40° C. to stabilize the spectral sensitization. After addition of a stabilizer, coating aid, and hardener, the emulsion was coated on a polyethylene-laminated paper support and dried. The coating materials were exposed in a sensitometer provided with a light source of a color temperature of 5,400° K. to determine the red sensitivity and white light sensitivity. The red sensitivity was measured by exposing the specimen to the light source through a red filter (Wratten No. 29). The sensitivity maximum was determined from the spectrogram obtained by means of a spectrograph of the diffraction grating type. The photographic material was developed in D-72 developer at 20° C. for 90 seconds, then passed through a stop bath and a fixing bath, and washed with water. A black and white image was obtained in the photographic material. Each strip was tested for the density by means of a densitometer (MACBETH TD-504 of Macbeth Corp., USA) to obtain red and white light sensitivities. The base point of optical density was 0.75 density. The results of these tests were shown in Table 1. In Table 1, the relative red sensitivity and the relative white light sensitivity are relative values obtained by assuming both sensitivities exhibited by 0.88 mg/g $AgNO_3$ of the sensitizing dye [I-A] to be 100; and the percentage supersensitization is the ratio (in %) of the sensitivity exhibited by the combination of sensitizing dyes to the sum of sensitivities exhibited by each dye. For reference, the following sensitizing dyes were used.

(I-a)

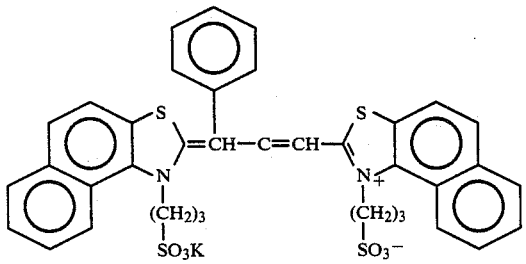

-continued
(II-a)
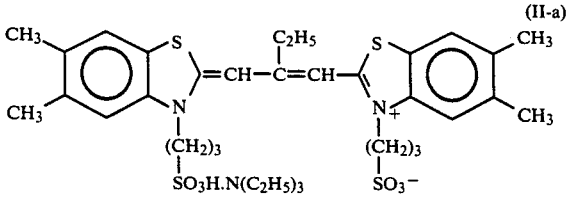
-continued
(II-b)
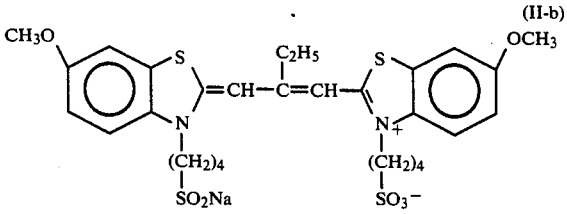
(II-c)
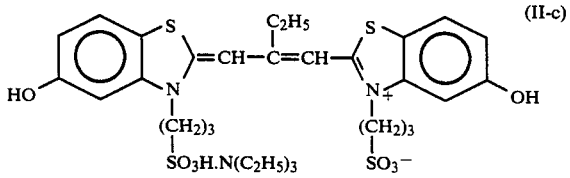
TABLE 1
| No. | Sensitizing dye and amount used (mg/g $AgNO_3$) | | | | Relative red sensitivity | Percent supersensitization (%) | Relative white light sensitivity | Percent supersensitization (%) |
|---|---|---|---|---|---|---|---|---|
| 1 | [I-A] | 0.88 | | | 100 | | 100 | |
| 2 | | 1.10 | | | 1.29 | | 115 | |
| 3 | | 1.32 | | | 148 | | 115 | |
| 4 | | | [II-C] | 1.10 | 115 | | 381 | |
| 5 | | 1.10 | | 1.10 | 631 | 259 | 576 | 116 |
| 6 | | | [II-D] | 0.88 | 302 | | 437 | |
| 7 | | 1.32 | | 0.88 | 708 | 157 | 570 | 103 |
| 8 | | | [II-G] | 0.44 | 57 | | 174 | |
| 9 | | | | 0.88 | 115 | | 316 | |
| 10 | | | | 1.10 | 148 | | 282 | |
| 11 | [I-A] | 0.88 | | 0.44 | 777 | 495 | 468 | 171 |
| 12 | | 0.88 | | 0.88 | 1,000 | 465 | 646 | 155 |
| 13 | | 1.10 | | 0.88 | 1,123 | 460 | 725 | 168 |
| 14 | | 1.10 | | 1.10 | 1,132 | 409 | 813 | 205 |
| 15 | | | [II-H] | 0.44 | 214 | | 289 | |
| 16 | | | | 0.88 | 288 | | 347 | |
| 17 | | | | 1.10 | 309 | | 347 | |
| 18 | [I-A] | 1.10 | | 0.44 | 501 | 146 | 424 | 105 |
| 19 | | 1.10 | | 0.88 | 631 | 151 | 478 | 103 |
| 20 | | 1.10 | | 1.10 | 550 | 126 | 472 | 102 |
| 21 | | 1.32 | | 0.44 | 603 | 167 | 407 | 101 |
| 22 | | 1.32 | | 0.88 | 692 | 159 | 479 | 104 |
| 23 | | | [II-Q] | 0.88 | 589 | | 479 | |
| 24 | [I-A] | 1.32 | | 0.88 | 1,107 | 150 | 617 | 104 |
| 25 | | | Ref. | 0.44 | 10 | | 38 | |
| 26 | | | (II-a) | 0.88 | 23 | | 69 | |
| 27 | [I-A] | 0.88 | | 0.44 | 113 | 103 | 105 | 76 |
| 28 | | 1.10 | | 0.88 | 158 | 104 | 118 | 64 |
| 29 | | | Ref. | 0.88 | 20 | | 205 | |
| 30 | [I-A] | 0.88 | (II-b) | 0.88 | 156 | 130 | 135 | 44 |
| 31 | | 1.10 | | 0.88 | 175 | 117 | 138 | 43 |
| 32 | Ref. | 0.88 | | | 25 | | 30 | |
| 33 | (I-a) | 1.10 | | | 29 | | 38 | |
| 34 | | | [II-G] | 0.88 | 115 | | 316 | |
| 35 | | 0.88 | | 0.88 | 123 | 88 | 316 | 91 |
| 36 | | 1.10 | | 0.88 | 120 | 83 | 316 | 89 |
| 37 | [I-C] | 1.10 | | | 269 | | 204 | |
| 38 | | 1.32 | | | 257 | | 209 | |
| 39 | | | [II-M] | 0.88 | 186 | | 372 | |
| 40 | | | | 1.10 | 195 | | 380 | |
| 41 | | 1.10 | | 0.88 | 478 | 105 | 586 | 102 |
| 42 | | 1.10 | | 1.10 | 514 | 111 | 595 | 102 |
| 43 | | 1.32 | | 0.88 | 511 | 115 | 594 | 102 |
| 44 | | | [II-O] | 1.10 | 148 | | 372 | |
| 45 | [I-C] | 1.10 | | 1.10 | 452 | 108 | 598 | 104 |
| 46 | [I-D] | 1.10 | | | 166 | | 204 | |
| 47 | | 1.32 | | | 209 | | 229 | |
| 48 | | | [II-M] | 0.88 | 186 | | 372 | |
| 49 | | 1.10 | | 0.88 | 575 | 163 | 599 | 104 |
| 50 | | 1.32 | | 0.88 | 646 | 164 | 619 | 103 |
| 51 | | | [II-R] | 0.88 | 251 | | 372 | |
| 52 | | 1.10 | | 0.88 | 537 | 129 | 594 | 103 |
| 53 | | 1.32 | | 0.88 | 589 | 128 | 613 | 102 |
| 54 | [I-E] | 0.88 | | | 141 | | 155 | |
| 55 | | 1.10 | | | 186 | | 186 | |
| 56 | | 1.32 | | | 209 | | 219 | |

TABLE 1-continued

| No. | Sensitizing dye and amount used (mg/g $AgNO_3$) | | | Relative red sensitivity | Percent supersensitization (%) | Relative white light sensitivity | Percent supersensitization (%) |
|---|---|---|---|---|---|---|---|
| 57 | | [II-A] | 1.10 | 158 | | 269 | |
| 58 | | | 1.32 | 214 | | 316 | |
| 59 | 0.88 | | 1.10 | 603 | 212 | 447 | 105 |
| 60 | 0.88 | | 1.32 | 563 | 159 | 501 | 106 |
| 61 | 1.10 | | 1.10 | 563 | 164 | 466 | 102 |
| 62 | 1.32 | | 1.10 | 661 | 180 | 502 | 103 |
| 63 | | [II-E] | 0.88 | 209 | | 195 | |
| 64 | 1.10 | | 0.88 | 616 | 156 | 389 | 102 |
| 65 | 1.32 | | 0.88 | 669 | 160 | 422 | 102 |
| 66 | | Ref. | 0.88 | 354 | | 309 | |
| 67 | 1.10 | (II-c) | 0.88 | 675 | 125 | 406 | 82 |
| 68 | 1.32 | | 0.88 | 602 | 107 | 401 | 76 |
| 69 | [I-F] 1.10 | | | 209 | | 331 | |
| 70 | | [II-G] | 0.88 | 115 | | 316 | |
| 71 | | | 1.10 | 148 | | 282 | |
| 72 | 1.10 | | 0.88 | 982 | 303 | 673 | 184 |
| 73 | 1.10 | | 1.10 | 1,209 | 339 | 680 | 111 |

As is apparent from the results shown in Table 1, the combination of sensitizing dyes according to this invention showed distinct improvement in red sensitivity as well as white light sensitivity as compared with the sensitivity when each dye is used alone or the reference dyes are used, indicating the usefulness of the combination of dyes according to this invention.

What is claimed is:

1. A silver halide photographic emulsion which contains a combination of at least one sensitizing dye represented by the general formula

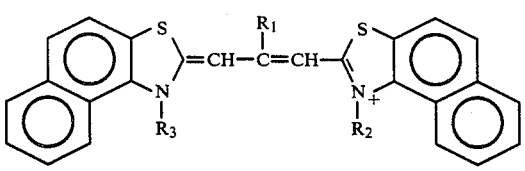

[I]

wherein $R_1$ represents a hydrogen atom, an alkyl group, or an aralkyl group, $R_2$ represents a sulfoalkyl group or a sulfoaralkyl group, and $R_3$ represents an unsubstituted or substituted alkyl group, and at least one sensitizing dye represented by the general formula

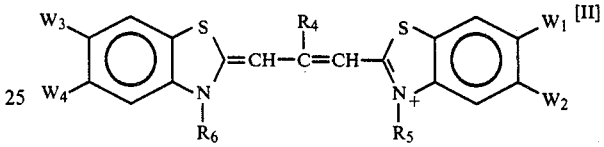

[II]

wherein $W_1$ to $W_4$ represent each an alkyl group, an alkoxy group, or a hydroxyl group, or a pair of $W_1$ and $W_2$ or a pair of $W_3$ and $W_4$ forms an alkylenedioxy group, provided that said pair of $W_1$ and $W_2$ and said pair of $W_3$ and $W_4$ have each at least one alkoxy or hydroxyl group or said alkylenedioxy group; $R_4$ represents a hydrogen atom, an alkyl group, an aralkyl group, or an aryl group; $R_5$ represents a sulfoalkyl group or a sulfoaralkyl group; and $R_6$ represents an unsubstituted for substituted alkyl group.

2. A silver halide photographic emulsion according to claim 1, wherein when the dye of general formula [I] is a sulfoanionic type, one of the sulfo group is in the form of an alkali metal salt or an ammonium salt.

3. A silver halide photographic emulsion according to claim 1, wherein when the dye of general formula [II] is a sulfoanionic type, one of the sulfo group is in the form of an alkali metal salt or an ammonium salt.

4. A silver halide photographic emulsion according to claim 1, wherein the sum of the dye of general formula [I] and the dye of general formula [II] is 0.01 to 10 g per 1 kg of silver halide in terms of silver nitrate.

5. A silver halide photographic emulsion according to claim 4, wherein the mixing ratio of the dye of general formula [I] to the dye of general formula [II] is from 10:1 to 1:10.

6. A photographic material comprising a support and an emulsion layer according to claim 1.

* * * * *